US007048607B1

(12) United States Patent
Wu et al.

(10) Patent No.: US 7,048,607 B1
(45) Date of Patent: May 23, 2006

(54) SYSTEM AND METHOD FOR CHEMICAL MECHANICAL PLANARIZATION

(75) Inventors: Li Wu, Fremont, CA (US); Sourabh Mishra, Campbell, CA (US); Young J. Paik, Campbell, CA (US); Satyasrayan Kumaraswamy, Sunnyvale, CA (US); Robert Lum, Sunnyvale, CA (US); Chiu Chan, Foster City, CA (US); David Groechel, Sunnyvale, CA (US)

(73) Assignee: Applied Materials, Santa Clara, CA (US)

( * ) Notice: Subject to any disclaimer, the term of this patent is extended or adjusted under 35 U.S.C. 154(b) by 1084 days.

(21) Appl. No.: 09/583,512

(22) Filed: May 31, 2000

(51) Int. Cl.
*B24B 7/22* (2006.01)
*B24B 49/00* (2006.01)

(52) U.S. Cl. ..... 451/5; 451/57

(58) Field of Classification Search ..... 451/53, 451/41, 65, 66, 57, 37, 288, 5
See application file for complete search history.

(56) References Cited

U.S. PATENT DOCUMENTS 5,605,487 A 2/1997 Hileman et al.
5,618,381 A 4/1997 Doan et al.
5,647,789 A * 7/1997 Kitta et al. ..... 451/288
5,692,947 A 12/1997 Talieh et al.
5,718,620 A * 2/1998 Tanaka et al. ..... 451/288
5,723,387 A 3/1998 Chen
5,749,769 A * 5/1998 Church et al. ..... 451/57
5,800,248 A 9/1998 Pant et al.
5,897,426 A 4/1999 Somekh
5,916,012 A 6/1999 Pant et al.
5,942,449 A 8/1999 Meikle
6,103,628 A 8/2000 Talieh ..... 438/692

FOREIGN PATENT DOCUMENTS

WO 98/45090 10/1998
WO 99/22908 5/1999

OTHER PUBLICATIONS

Birang et al. "Apparatus and Method for Chemical Mechanical Polishing with an Advanceable Polishing Sheet" U.S. Appl. No. 09/244,456, filed Feb. 4, 1999.

* cited by examiner

*Primary Examiner*—Robert A. Rose
(74) *Attorney, Agent, or Firm*—Patterson and Sheridan

(57) ABSTRACT

Generally, a method and apparatus for processing a substrate. In one embodiment, the method provides a first relative motion between at least a first substrate and a polishing material. A second relative motion is provided between at least a second substrate and the polishing material. The changing in direction of the relative motion extends the interval between conditioning procedures used to return the polishing material to a state that produces uniform polishing results.

23 Claims, 6 Drawing Sheets

SYSTEM AND METHOD FOR CHEMICAL MECHANICAL PLANARIZATION

BACKGROUND OF THE DISCLOSURE

1. Field of Invention

Embodiments of the present invention relate generally to a processing system and a method for polishing a substrate.

2. Background of Invention

In semiconductor wafer processing, the use of chemical mechanical planarization, or CMP, has gained favor due to the enhanced ability to increase device density on a semiconductor workpiece, or substrate, such as a wafer. As the demand for planarization of layers formed on wafers in semiconductor fabrication increases, the requirement for greater system (i.e., process tool) throughput with less wafer damage and enhanced wafer planarization has also increased.

Two exemplary CMP systems that address these issues are described in U.S. Pat. No. 5,804,507, issued Sep. 8, 1998 to Perlov et al. and in U.S. Pat. No. 5,738,574, issued Apr. 15, 1998 to Tolles et al., both of which are incorporated by reference. Perlov et al. and Tolles et al. disclose a CMP system having a planarization system that is supplied wafers from cassettes located in an adjacent liquid filled bath. A transfer mechanism, or robot, facilitates the transfer of the wafers from the bath to a transfer station. The transfer station generally contains a load cup that positions wafers into one of four processing heads mounted to a carousel. The carousel moves each processing head sequentially over the load cup to receive a wafer. As the processing heads are loaded, the carousel moves the processing heads and wafers through the planarization stations for polishing. The wafers are planarized by moving the wafer relative to a polishing material or pad in the presence of a slurry or other polishing fluid medium. The polishing pad may include an abrasive surface. The slurry typically contains both chemicals and abrasives that aid in the removal of material from the wafer. After completion of the planarization process, the wafer is returned back through the transfer station to the proper cassette located in the bath.

Conventional polishing pads are generally comprised of a foamed polymer having a textured or porous surface. The textured or porous surface functions to retain the polishing fluid on the polishing pad during the polishing operation. For example, during the polishing motion of the substrate relative to the polishing pad, the polishing fluid may be swept or spun off of the surface of the polishing pad, or otherwise become non-uniform between the polishing pad and substrate. The non-uniformity of polishing fluid between the polishing pad and substrate, such as less fluid or fluid component (chemical or abrasive) in one location as opposed to another location, may lead to a non-uniform rate of material removal (e.g., poor planarization) from the substrate.

Over the course of processing a number of wafers, the texture or pores on the polishing surface may become glazed over with polishing byproducts or deformed by forces applied to the polishing surface during polishing. For example, pores residing in the polishing surface generally are orientated normal to the polishing surface, and have a certain open area. As the forces applied to the polishing surface during polishing deform the polishing surface, the open area of the pores become increasingly smaller or have their openings on the polishing surface closed off. Reduced area pores and closed pores have a diminished polishing fluid retaining capacity. As the pores are continued to be pushed one side after repeated polishing operations, the pores in the polishing surface may no longer be able to properly (i.e., uniformly) retain the polishing fluid during polishing. In order to return the polishing surface to a condition that supports a uniform rate of planarization, the polishing pad must be conditioned. For example, when polishing tungsten, pores quickly become closed and may require conditioning of the polishing surface after polishing between 100 to 300 wafers.

Conditioning is generally performed by using a silicon carbide or other hard material or textured element which may be placed against the polishing pad to dress (e.g., return) the polishing pad to a state where the polishing fluid is adequately retained. Generally, the conditioning operation must be performed periodically in order to maintain uniform planarization from wafer to wafer and even within a wafer. Since no wafers may be processed during the conditioning operation, valuable production time and product capacity is lost during each conditioning operation.

Therefore, there is a need in the art for a apparatus and process that reduces the need to condition the polishing pad.

SUMMARY OF INVENTION

One aspect of the present invention generally provides a method for processing of a substrate. In one embodiment, the method provides a first relative motion between at least one substrate and a polishing material. A second relative motion is provided between at least another substrate and the polishing material. Embodiments may include providing the first and second motions in opposite directions. Additionally, embodiments may include processing one or more than one substrate before changing motions and planarizing the substrates using a chemical mechanical polishing process among other embodiments.

In another aspect of the invention, an apparatus for processing substrates is provided. In one embodiment, an apparatus includes a polishing head adapted to retain a substrate during processing. A polishing material disposed below the polishing head. The polishing material is movable relative to the polishing head in a first direction and a second direction. The polishing material moves in the first direction when polishing one substrate and in the second direction when polishing another substrate.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION OF INVENTION

Figure 1:
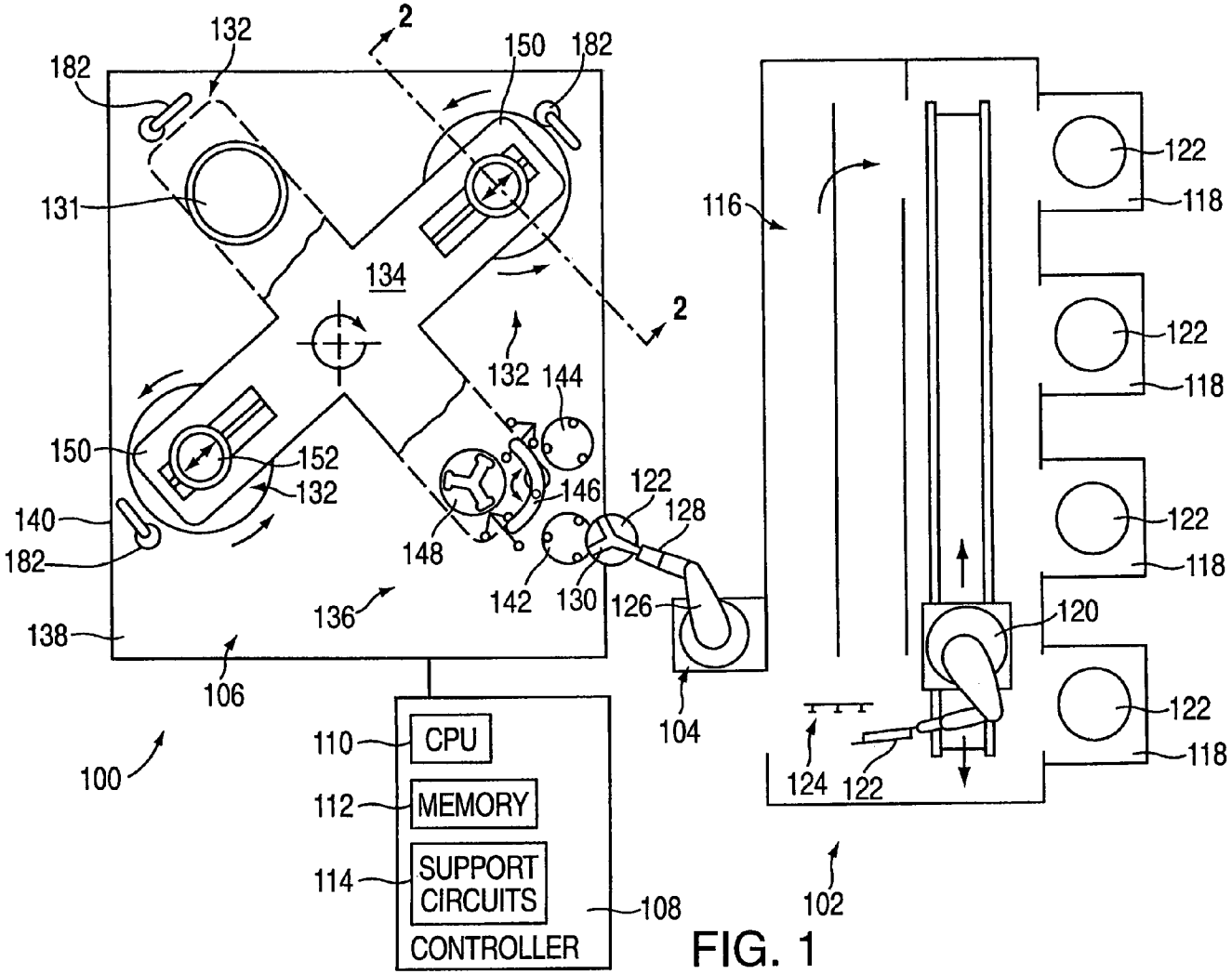
FIG. 1 is a plan view of a chemical mechanical planarization system of the invention.

FIG. 1 depicts a plan view of one embodiment of a chemical mechanical planarization system 100. The exemplary system 100 generally comprises a factory interface 102, a loading robot 104, and a polishing module 106. Generally, the loading robot 104 is disposed proximate the factory interface 102 and the polishing module 106 to facilitate the transfer of substrates 122 therebetween.

A controller 108 is provided to facilitate control and integration of the modules comprising the system 100. The controller 108 comprises a central processing unit (CPU) 110, a memory 112, and support circuits 114. The controller 108 is coupled to the various components of the system 100 to facilitate control of, for example, the polishing, cleaning and transfer processes.

The factory interface 102 generally includes a cleaning module 116 and one or more wafer cassettes 118. An interface robot 120 is employed to transfer substrates 122 between the wafer cassettes 118, the cleaning module 116 and an input module 124. The input module 124 is positioned to facilitate transfer of substrates 122 between the polishing module 106 and the factory interface 102 by the loading robot 104. For example, unpolished substrates 122 retrieved from the cassettes 118 by the interface robot 120 may be transferred to the input module 124 where the substrates 122 may be accessed by the loading robot 104 while polished substrates 122 returning from the polishing module 106 may be placed in the input module 124 by the loading robot 104. Polished substrates 122 are typically passed from the input module 124 through the cleaning module 116 before the factory interface robot 120 returns the cleaned substrates 122 to the cassettes 118. An example of such a factory interface 102 that may be used to advantage is disclosed in U.S. patent application Ser. No. 09/547,189, filed Apr. 11, 2000, which is hereby incorporated by reference.

The loading robot 104 is generally positioned proximate the factory interface 102 and the polishing module 106 such that the range of motion provided by the robot 104 facilitates transfer of the substrates 122 therebetween. An example of a loading robot 104 is a 4-Link robot, manufactured by Kensington Laboratories, Inc., located in Richmond, Calif.

The exemplary loading robot 104 has an articulated arm 126 having a rotary actuator 128 at its distal end. An edge contact gripper 130 is coupled to the rotary actuator 128. The rotary actuator 128 permits the substrate 122 secured by the gripper 130 to be orientated in either a vertical or a horizontal-orientation without contacting the feature side 120 of the substrate 122 and possibly causing scratching or damage to the exposed features. Additionally, the edge contact gripper 130 securely holds the substrate 122 during transfer, thus decreasing the probability that the substrate 122 will become disengaged. Optionally, other types of grippers, such as electrostatic grippers, vacuum grippers and mechanical clamps, may be substituted.

One polishing module 106 that can be used to advantage with the present invention is a Mirra® Chemical Mechanical Polisher, manufactured by Applied Materials, Inc., located in Santa Clara, Calif. Other polishing modules 102 including those that use polishing pads, polishing webs, or a combination thereof may also be used to advantage. Other systems that benefit include systems that move a substrate relative a polishing surface in a rotational, linearly or in other motion within a plane.

The exemplary polishing module 106 has a transfer station 136, a plurality of polishing stations 132 and a carousel 134 disposed on an upper or first side 138 of a machine base 140. In one embodiment, the transfer station 136 comprises at least an input buffer station 142, an output buffer station 144, a transfer robot 146, and a load cup assembly 148. The loading robot 104 places the substrate 122 onto the input buffer station 142. The transfer robot 146 has two gripper assemblies, each having pneumatic gripper fingers that grab the substrate 122 by the substrate's edge. The transfer robot 146 lifts the substrate 122 from the input buffer station 142 and rotates the gripper and substrate 122 to position the substrate 122 over the load cup assembly 148, then places the substrate 122 down onto the load cup assembly 148. An example of a transfer station that may be used to advantage is described by Tobin in U.S. patent application Ser. No. 09/314,771, filed Oct. 6, 1999, which is hereby incorporated by reference.

The carousel 134 is generally described by Tolles in the previously incorporated U.S. Pat. No. 5,804,507. Generally, the carousel 134 is centrally disposed on the base 140. The carousel 134 typically includes a plurality of arms 150, each supporting a polishing head assembly 152. Two of the arms 150 depicted in FIG. 1 are shown in phantom such that a polishing surface 131 of one of the polishing stations 132 and the transfer station 136 may be seen. The carousel 134 is indexable such that the polishing head assemblies 152 may be moved between the polishing stations 132 and the transfer station 136.

Generally, a chemical mechanical polishing process is performed at each polishing station 132.

A conditioning device 182 is disposed on the base 140 adjacent each polishing station 132. The conditioning device 182 periodically conditions the polishing surface 131 to maintain uniform polishing results.

Figure 2:
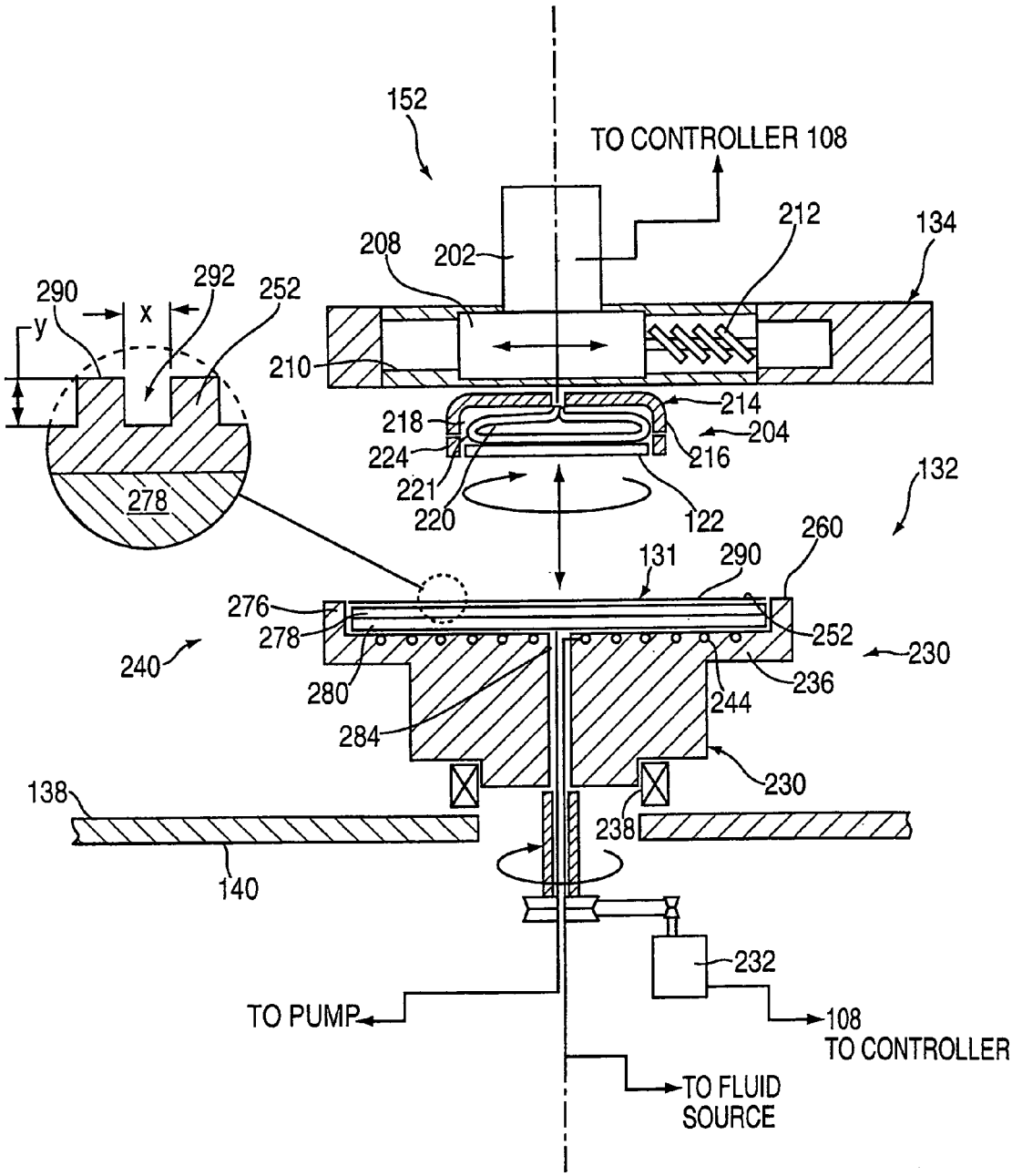
FIG. 2 is a sectional view of a polishing station taken along section line 2—2 of FIG. 1.

FIG. 2 depicts a sectional view of the polishing head assembly 152 supported above the polishing station 132. The polishing head assembly 152 generally comprises a drive system 202 coupled to a polishing head 204. The drive system 202 generally provides rotational motion to the polishing head 204. The polishing head 204 additionally may be actuated to extend towards the polishing station 132 such that the substrate 122 retained in the polishing head 204 may be disposed on the polishing station 132. The drive system 202 is coupled to the controller 108 that provides a signal to the drive system 202 controlling the rotational speed and direction of the polishing head 204.

The drive system 202 is coupled to a carrier 208 that translates upon a rail 210 disposed in the arm 150 of the carousel 134. A ball screw or other linear motion device 212 couples the carrier 208 to the carousel 134 and positions the drive system 202 and polishing head 204 along the rail 210.

In one embodiment, the polishing head 204 is a TITAN HEAD wafer carrier manufactured by Applied Materials, Inc., Santa Clara, Calif. Generally, the polishing head 204 comprises a housing 214 having an extending lip 216 that defines a center recess 218 in which is disposed a bladder 220. The bladder 220 may be comprised of an elastomeric material or thermoplastic elastomer such as ethylene propylene, silicone and HYTREL™. The bladder 220 is coupled to a fluid source (not shown) such that the bladder 220 may be controllably inflated or deflated. The bladder 220, when in contact with the substrate 122, retains the substrate 122 within the polishing head 204 by deflating, thus creating a vacuum between the substrate 122 and the bladder 220. A retaining ring 224 circumscribes the polishing head 204 to retain the substrate 122 within the polishing head 204 while polishing.

The polishing station 132 generally comprises a platen 230 that is disposed on the base 140. The platen 230 is generally comprised of aluminum. The platen 230 is supported above the base 140 by a bearing 238 so that the platen 230 may rotate in relation to the base 140. An area of the base 140 circumscribed by the bearing 238 is open and provides a conduit for the electrical, mechanical, pneumatic, control signals and connections communicating with the platen 230.

Conventional bearings, rotary unions and slip rings (not shown) are provided such that electrical, mechanical, pneumatic, control signals and connections may be coupled between the base 140 and the rotating platen 230. The platen 230 is typically coupled to a motor 232 that provides the rotational motion to the platen 230. The motor 232 is coupled to the controller 108 that provides a signal controlling the rotational speed and direction of platen 230.

The platen 230 has an upper portion 236 that supports a polishing material 252. Generally, the upper portion 236 is circular when using "stick-down" or adhesive backed polishing material 252, or rectangular when using polishing material 252 comprising a web. A top surface 260 of the platen 230 contains a center recess 276 extending into the top portion 236. The top portion 236 may optionally include a plurality of passages 244 disposed adjacent to the recess 276. The passages 244 are coupled to a fluid source (not shown). Fluid flowing through the passages 244 may be used to control the temperature of the platen 230 and the polishing material 252 disposed thereon.

A subpad 278 and a subplate 280 are disposed in the center recess 276. The subpad 278 is typically a plastic, such as foamed polyurethane, having a durometer selected to produce a particular polishing result. The subpad 278 generally conforms to the plane of the substrate 122 held in the polishing head 204 and promotes global planarization of the substrate 122. The subplate 280 is positioned between the subpad 278 and the bottom of the recess 276 such that the upper surface of the subpad 278 is coplanar with the top surface 260 of the platen 230.

Both the subpad 278 and the subplate 280 optionally contain a plurality of apertures 282 that are generally disposed in a pattern such that the polishing motion of the substrate 122 does not cause a discrete portion of the substrate 122 to pass repeatedly over the apertures 282 while polishing as compared to the other portions of the substrate 122. A vacuum port 284 is provided in the recess 276 and is coupled to an external pump (not shown). When a vacuum is drawn through the vacuum port 284, the air removed between the polishing material 252 and the subpad 278 causes the polishing material 252 to be firmly secured to the subpad 278 during polishing. An example of such polishing material retention system is disclosed in U.S. patent application Ser. No. 09/258,036, filed Feb. 25, 1999, by Sommer et al., which is hereby incorporated by reference. The reader should note that other types of devices may be utilized to fix the polishing material 252 to the platen 230, for example adhesives, bonding, electrostatic chucks, mechanical clamps and other retention mechanisms.

The polishing material 252 may comprise a polishing pad or web having a smooth surface, a textured surface, a surface containing a fixed abrasive or a combination thereof. The polishing material 252 may be in the form of a roll or sheet (e.g., pad) of material that may be advanced across or releasably fixed to the polishing surface. Typically, the polishing material 252 is releasably fixed by adhesives, vacuum, mechanical clamps or by other holding methods to the platen 230.

The polishing material 252 may optionally include fixed abrasives. Polishing material 252 without fixed abrasives are generally comprised of polyurethane and used with polishing fluids that include abrasives. Conventional material 252 (i.e., pads without fixed abrasives) are available from Rodel, Inc., of Newark, Del.

In one embodiment, a working surface 290 of the polishing material 252 contains a plurality of pores 292 formed therein. The pores 292 generally have a diameter X and a depth Y. The pores 292 provide a surface topography that retains a portion of the polishing fluid between the surface 290 and the substrate 122 which would other wise be swept off during polishing. The retained polishing fluid enhances the planarization rate and polishing uniformity of the substrate 122.

To facilitate control of the system as described above, the CPU 110 of FIG. 1 may be one of any form of computer processor that can be used in an industrial setting for controlling various chambers and subprocessors. The memory 112 is coupled to the CPU 110. The memory 112, or computer-readable medium, may be one or more of readily available memory such as random access memory (RAM), read only memory (ROM), floppy disk, hard disk, or any other form of digital storage, local or remote. The support circuits 114 are coupled to the CPU 110 for supporting the processor in a conventional manner. These circuits include cache, power supplies, clock circuits, input/output circuitry and subsystems, and the like. A process, for example a polishing process 300 described below, is generally stored in the memory 112, typically as a software routine. The software routine may also be stored and/or executed by a second CPU (not shown) that is remotely located from the hardware being controlled by the CPU 110.

Although the process of the present invention is discussed as being implemented as a software routine, some or all of the method steps that are disclosed therein may be performed in hardware as well as by the software controller. As such, the invention may be implemented in software as executed upon a computer system, in hardware as an application specific integrated circuit or other type of hardware implementation, or a combination of software and hardware.

Figure 3:
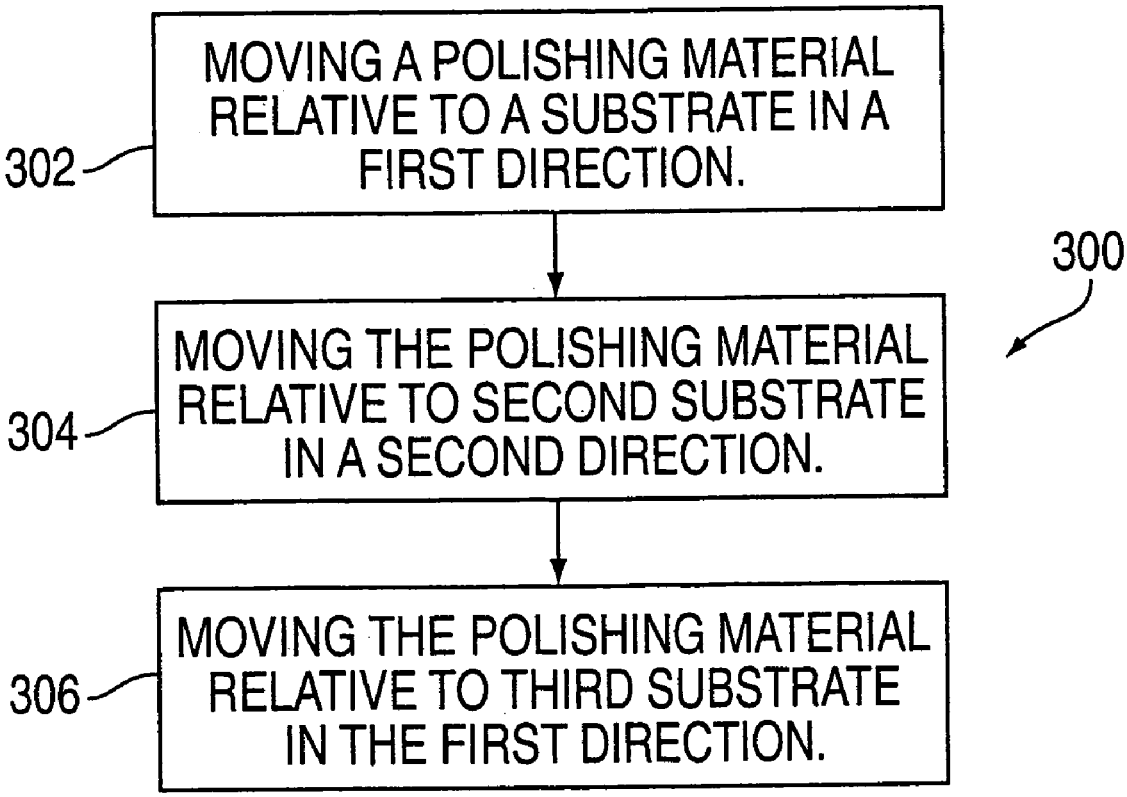
FIG. 3 is a flow diagram depicting a polishing process.

FIG. 3 depicts a flow diagram of one embodiment of the polishing process 300. Generally, the process 300 is a chemical mechanical polishing process that includes moving a substrate disposed against the polishing surface 131 in the presence of a chemical agent(s) provided by a polishing fluid disposed on the polishing surface 131. At step 302, the polishing material 252 is moved in a first direction relative to a substrate to provide a first relative motion. The first direction and first relative motion may include a predefined series of motions such as a polishing pattern or path traversed during the polishing cycle of the substrate. The first relative motion in one embodiment is generally provided by rotating the platen 230 having the polishing material 252 disposed thereon in a first rotational direction (i.e., clockwise or counter-clockwise). The polishing head 204 is typically rotated in the same rotational direction as the platen 230. Optionally, the polishing head 204 may be moved radially along the arm 150. The combined motions of the platen 230 and polishing head 204 result to define the first direction. A predetermined number or first batch of substrates (e.g., at least one) are processed in step 302. The method 300 then proceeds to step 304.

At step 304, the polishing material 252 is moved in a second direction relative to predetermined number or second batch of substrates (e.g., at least one) to provide a second relative motion which is different than the first relative motion. The second direction and second relative motion may also include a predefined series of motions such as a polishing pattern or path traversed during the polishing cycle by the second batch of substrates over the same portion of polishing media traverse by the first batch of substrates. Generally, the second direction is provided by rotating the platen 230 in a second rotational direction (i.e., opposite the first rotational direction). The second batch of substrates are processed in step 304 before proceeding to step 306. The number of substrates in the first and second batches may be vary or be identical in quantity.

At step 306, the polishing material 252 is moved relative to a predetermined number or third batch substrates (e.g., at least one) in the first direction. Generally, the second direction is provided by rotating the platen 230 in a same rotational direction as in step 302.

The process 300 may be continued by reversing the relative polishing direction between sets of substrates until the polishing material 252 can no longer maintain uniform polishing due to normal wear or the like. Once this state is reached, the polishing material 252 may be conditioned by the conditioning device in a conventional fashion or may be replaced.

The reversing of the relative motion between the substrate and the polishing material diminishes the severity of deformation to the topography of the polishing material, thus allowing more substrates to be processed between conditioning operations. For example, when polishing tungsten disposed on the substrate, up to 500 or more substrates may be polished between conditioning procedures.

Additionally, during process 300, the polishing material 252 may be cooled by flowing temperature control fluid through the passages 244 in the platen 230. Cooling the polishing material 252 slows the deformation of the surface 290 by increasing the durometer (e.g., hardness) of the polishing material 252, extending the number of substrates that may be polished during each step of the process 300. Polishing material 252 having higher durometer deforms more slowly thus extending the number of polishing cycles needed to bring the polishing material to a condition wherein the direction of polishing should be reversed to maintain good polishing results. Optionally, the temperature control fluid may be used to heat the platen 230 and the polishing material 252.

Figure 4:
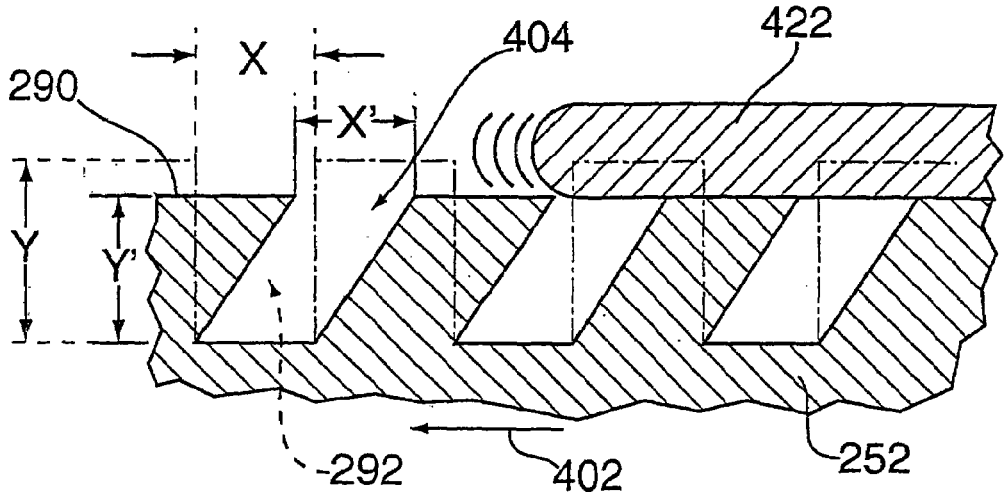
FIG. 4 is a sectional view of a polishing material illustrating the surface topography at one instance during the polishing process of FIG. 3.
Figure 5:
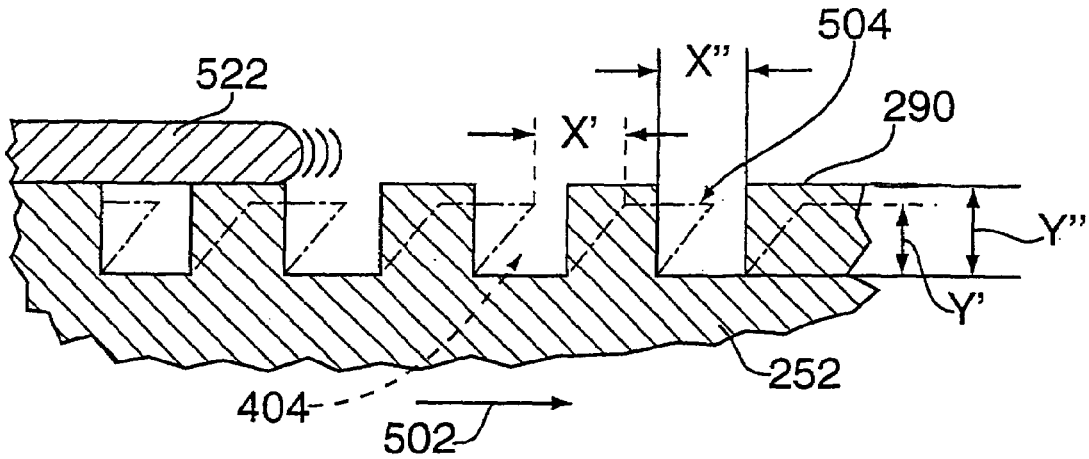
FIG. 5 is a sectional view of a polishing material illustrating the surface topography at another instance during the polishing process of FIG. 3.
Figure 6:
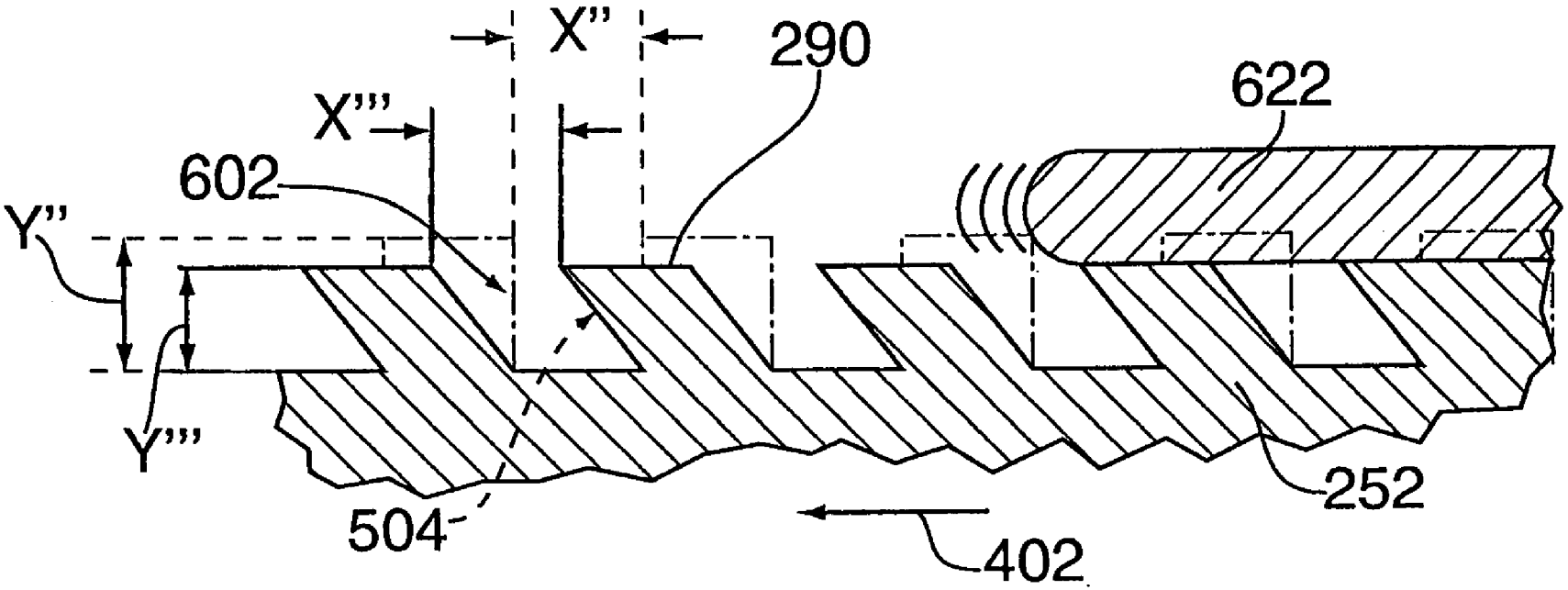
FIG. 6 is a sectional view of a polishing material illustrating the surface topography at another instance during the polishing process of FIG. 3.

FIGS. 4–6 depict steps 302, 304 and 306 the process 300, respectively. The drawings have been exaggerated to provide clarity during explanation of the process 300. Specifically, FIG. 4 illustrates step 302. The motion in the first direction of the polishing material 252 relative a substrate 422 is depicted by arrow 402. Forces between the polishing material 252 and the substrate 422 causes the surface 290 of the polishing material 252 to deform and wear. For example, the pores 292 (shown in phantom) residing to the surface 290 of the polishing material 252 may be deformed, worn or dragged by frictional and other forces between the substrate 422 and the polishing material 252 to a canted orientation shown as pores 404 after a number of polishing cycles. The canted pores 404 have a diameter X' and a depth Y'. As illustrated, X' is generally less than X and Y' is generally less than Y, leaving the pores 404 in a partially closed condition. Thus, the relative capacity of the pore 292 relative to the pore 404 to retain the polishing fluid becomes diminished. Generally, when using a conventional polishing apparatus, the polishing material 252 approaches a point where polishing needs to be suspended and a conditioning procedure performed on the polishing material 252 to return the polishing material 252 to a state that produces desirable polishing results. The need for conditioning at this stage is averted by proceeding to step 304.

FIG. 5 illustrates the change in relative motion between polishing material 252 and a substrate 522 by arrow 502 that represents the second relative motion in the second direction. Generally, the change in direction occurs after the completion of a polishing operation on at least one substrate. Optionally, the change may occur after a portion of a polishing cycle. The canted pores 404 (shown in phantom) have been pushed by frictional and other forces to an orientation depicted by pores 504 similar to the original orientation of the pores 292 of FIG. 2. The straightened pores 504 have a diameter X" and a depth Y". As illustrated, X" is generally greater than X" and Y" is generally greater than Y'. Thus, the relative capacity of the pores 504 relative to the pores 404 to retain the polishing fluid is returned to near the condition of pores 292. Generally, polishing in the second direction is continued until the pores 504 reach an orientation depicted by pores 602 of FIG. 6 at which point step 304 terminates and step 306 begins.

FIG. 6 illustrates the relative motion between polishing material 252 and a substrate 522 returning to the second direction as depicted by arrow 402. The straightened pores 504 (shown in phantom) have been pushed by frictional and other forces to a canted orientation depicted by pores 602. The orientation of pores 602 is generally opposite to the orientation of the pores 404 of FIG. 4. The pores 602 have a diameter X'" and a depth Y'". As illustrated, X'" is generally smaller than X" and Y'" is smaller than Y". Thus, the relative capacity of the pores 602 relative to the pores 504 to retain the polishing fluid is similar to the capacity of pores 404. Generally, polishing in the first direction is continued until the pores 602 approach a point where polishing uniformity is near the boundary of an acceptable process window. At this point, the direction of relative motion would be reversed to re-open the pores of the polishing material. Each time the polishing direction is reversed, the pores are returned from the partially closed condition to a condition having a polishing fluid retention capability closer to the polishing material's original condition. Thus, the polishing material's ability to maintain uniform polishing results between conditioning procedures is extended by reversing the relative polishing direction.

In one embodiment, the relative polishing direction is reversed after each wafer is polished. For example, a first substrate may be polished in a first direction while a subsequent substrate is polished in a second direction that is opposite the first direction. The polishing direction is reversed after polishing each substrate to minimize the deformation of the polishing surface. In another embodiment, the relative polishing direction is reversed after a first batch or predetermined number of wafers are polished to polish another batch of substrates. Thus, the polishing motion is maintain in the first direction while polishing a number of substrates that comprised the first batch consecutively. Once the first batch is polished, the polishing motion is reversed to the second direction. The second batch is then consecutively polished while maintaining the polishing motion in the second direction.

Generally, by reversing the relative polishing motion, the surface topography may "oscillate" to either side of its original orientation, and continue to hold the polishing fluid for a greater number of polishing cycles than polishing processes that have a single (or repeated) motion. Although the process 300 has been illustrated using a polishing material 252 having pores 292 disposed in the surface 290, the process 300 is equally applicable to polishing surfaces 131 having other types of surface topography.

For example, ridges or grooves formed in a polishing surface 131 (i.e., by a conditioning procedure) may be deformed or distorted toward a given side by fictional and other forces subjected to the surface 131 during polishing. By reversing the relative motion of the polishing surface 131, the ridges or grooves will be "pushed" back through original orientation. Thus, the capacity of the polishing surface 131 to hold fluid is increased after each change in polishing direction. Additionally, complex polishing patterns between a substrate and a polishing material may be reversed to change the relative motion of the substrate against the surface topography.

In another embodiment of the invention, the first relative direction may be reversed to the second relative direction during the polishing of a given substrate.

One skilled in the art will also recognize that the process 300 may alternatively be practiced on polishing systems wherein substrates move linearly in one or more directions relative to a polishing material. Examples of such systems provide planar (e.g., motion in two axis such as x/y) motion to either the substrate or polishing material, move the polishing material in a continuous, belt-like motion, or provide other motion between the substrate and polishing material. Such systems may additionally rotate one or both of the substrate or polishing material. An example of a system that may be used to advantage having a planar polishing motion provided by the integration of two perpendicular, linear drives is described by Sommer in U.S. patent application Ser. No. 60/185,812, filed Feb. 29, 2000, which is hereby incorporated by reference.

Figure 7:
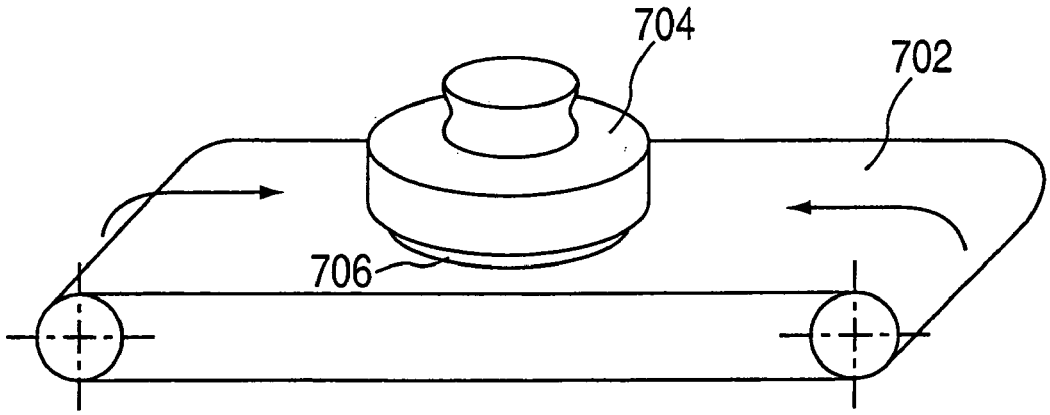
FIG. 7 is a simplified perspective of another chemical mechanical planarization system.

FIG. 7 depicts a simplified perspective view of another embodiment of a polishing system. A system 700 generally comprises a web 702 of polishing material disposed beneath a substrate 706 that is retained in a polishing head 704. The polishing head 704 selectively places the substrate 706 in contact with the web 702 during polishing. During polishing one or more substrates comprising a first batch of substrates, the web 702 is advanced in a first direction to provide a first relative motion between the substrate 706 and the web 702. After the first batch is processed, a second batch of substrates (comprising at least one or more substrates) is processed by advancing the web 702 in a second direction to provide a second relative motion between the substrate 706 and the web 702. Typically, the second direction is opposite the first direction.

Figure 8:
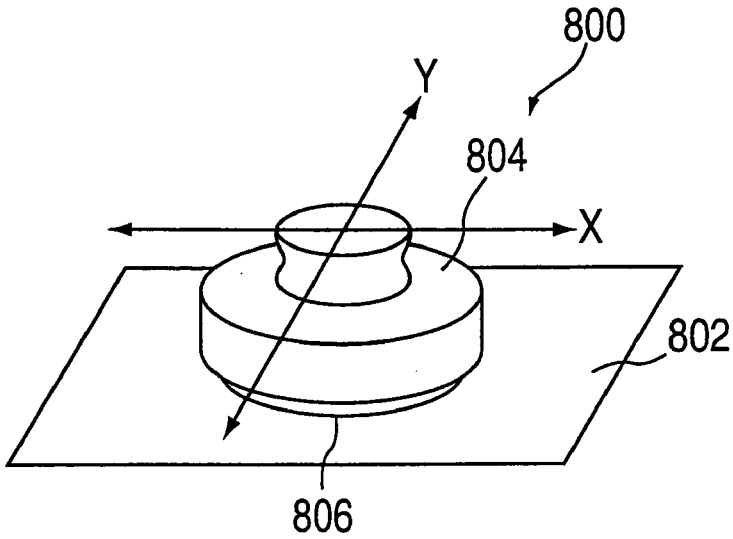
FIG. 8 is a simplified perspective of another chemical mechanical planarization system.

FIG. 8 depicts a simplified perspective view of another embodiment of a polishing system. A system 800 generally comprises a polishing material 802. A substrate 806 is retained in a polishing head 804 that places a substrate 806 in contact with the polishing material 802 during polishing. The polishing material 802 may be substantially similar to the polishing material 252 described above with reference to FIG. 2. During polishing one or more substrates comprising a first batch of substrates, the polishing head 804 is moved in a first direction (comprising a sequenced x/y movement) to provide a first relative motion between the substrate 806 and the polishing material 802 such that the substrate traverses a polishing path (i.e., a pattern) over a portion of polishing material. After the first batch is processed, a second batch of substrates (comprising at least one or more substrates) is processed by moving the polishing head 804 in a second direction defined by performing the sequence defining the first direction in reverse. The second direction provides a second relative motion between the substrate 806 and the polishing material 802 such that the substrate traverses the same portion of polishing material by following the polishing path in reverse. The first and second relative motions may be provided by moving either the polishing material 802, the polishing head 804 or a combination thereof.

Although the teachings of the present invention that have been shown and described in detail herein, those skilled in the art can readily devise other varied embodiments that still incorporate the teachings and do not depart from the scope and spirit of the invention.

What is claimed is:

1. A method for processing substrates comprising:

providing a first relative motion between at least one substrate and a polishing material by moving a polishing head in a planar motion, wherein the providing the first relative motion further comprises moving the polishing material in a linear direction; and providing a second relative motion between at least another substrate and the polishing material, wherein the first relative motion or the second relative motion further comprises rotating a platen supporting the polishing material.

2. A method for processing substrates comprising:

providing a first relative motion between at least one substrate and a polishing material by moving a polishing head in a planar motion, wherein the providing the first relative motion further comprises processing additional substrates utilizing the first relative motion between the at least one substrates and the polishing material before providing the second relative motion between the at least another substrate and the polishing material; and providing a second relative motion between at least another substrate and the polishing material, wherein the first relative motion or the second relative motion further comprises rotating a platen supporting the polishing material.

3. The method of claim 2, wherein the providing the second relative motion further comprises:

processing additional substrates utilizing the second relative motion between the at least another substrate and the polishing material.

4. The method of claim 2 further comprising:

processing another batch of substrates utilizing the first relative motion between the substrates and the polishing material.

5. A method for processing substrates comprising:

providing a first relative motion between at least one substrate and a polishing material by moving the polishing material in a linear direction; and providing a second relative motion between at least another substrate and the polishing material, wherein the first relative motion or the second relative motion further comprises rotating a platen supporting the polishing material.

6. The method of claim 5, wherein the providing the first relative motion further comprises:

performing a chemical mechanical planarization process.

7. The method of claim 5, wherein the providing the first relative motion further comprises:

rotating a platen supporting the polishing material.

8. The method of claim 5, wherein the providing the second relative motion further comprises:

rotating a platen supporting the polishing material in a direction opposite a rotational direction of the first relative motion.

9. The method of claim 5, wherein the providing the first relative motion further comprises:

moving a polishing head retaining the first substrate.

10. The method of claim 5, wherein the providing the first relative motion further comprises:

moving the polishing head in a planar motion.

11. The method of claim 5, wherein the providing the first relative motion further comprises:

processing additional substrates utilizing the first relative motion between the at least one substrates and the polishing material before providing the second relative motion between the at least another substrate and the polishing material.

12. The method of claim 11, wherein the providing the second relative motion further comprises:

processing additional substrates utilizing the second relative motion between the at least another substrate and the polishing material.

13. The method of claim 11 further comprising:

processing another batch of substrates utilizing the first relative motion between the substrates and the polishing material.

14. The method of claim 5, wherein the first relative motion is opposite the second relative motion.

15. The method of claim 5 further comprising:

processing a third substrate utilizing the first relative motion.

16. A method for processing substrates comprising:

providing a first relative motion between at least one substrate and a polishing material by moving the polishing material in a linear direction;

providing a second relative motion between at least another substrate and the polishing material; and flowing a temperature control fluid through passages disposed in a platen having the polishing material disposed thereon.

17. The method of claim 16, wherein the flowing the temperature control fluid through the platen further comprises:

reducing the temperature of the polishing material.

18. A method for processing substrates comprising:

providing a first relative motion between at least one substrate and a polishing material, wherein the providing the first relative motion comprises moving the polishing material in a linear direction;

providing a second relative motion between at least another substrate and the polishing material;

processing additional substrates utilizing the first relative motion between the at least one substrates and the polishing material before providing the second relative motion between the at least another substrate and the polishing material, wherein the first relative motion or the second relative motion comprises rotating a platen supporting the polishing material.

19. The method of claim 18, wherein the providing the second relative motion further comprises:

processing additional substrates utilizing the second relative motion between the at least another substrate and the polishing material.

20. The method of claim 18 further comprising:

processing another batch of substrates utilizing the first relative motion between the substrates and the polishing material.

21. A method for processing substrates comprising:

providing a first relative motion between at least one substrate and a polishing material;

providing a second relative motion between at least another substrate and the polishing material;

processing additional substrates utilizing the first relative motion between the at least one substrates and the polishing material before providing the second relative motion between the at least another substrate and the polishing material; and flowing a temperature control fluid through passages disposed in a platen having the polishing material disposed thereon.

22. The method of claim 21, wherein the flowing the temperature control fluid through the platen further comprises:

reducing the temperature of the polishing material.

23. The method of claim 5, wherein the first relative motion is provided by the integration of two perpendicular, linear drives to move the polishing material in a linear direction.

* * * * *

UNITED STATES PATENT AND TRADEMARK OFFICE

CERTIFICATE OF CORRECTION

PATENT NO. : 7,048,607 B1
APPLICATION NO. : 09/583512
DATED : May 23, 2006
INVENTOR(S) : Li Wu et al.

It is certified that error appears in the above-identified patent and that said Letters Patent is hereby corrected as shown below:

In the Specification

Column 4, Line 58: After “HEAD”, insert --™--

Column 8, Line 20: After “than”, change “ X” ” to --X’--

Column 8, Line 60: Change “maintain” to --maintained--

Signed and Sealed this

Twenty-first Day of November, 2006

JON W. DUDAS
*Director of the United States Patent and Trademark Office*